US010138718B2

(12) United States Patent
Rodgers et al.

(10) Patent No.: US 10,138,718 B2
(45) Date of Patent: Nov. 27, 2018

(54) PERFORATION CRACK DESIGNATOR

(71) Applicant: HALLIBURTON ENERGY SERVICES, INC., Houston, TX (US)

(72) Inventors: John Rodgers, Southlake, TX (US); Timothy S. Glenn, Dracut, MA (US); Marco Serra, Winterthur (CH); Michael Fripp, Carrolton, TX (US); Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/317,886

(22) PCT Filed: Jul. 9, 2014

(86) PCT No.: PCT/US2014/046028

§ 371 (c)(1),
(2) Date: Dec. 9, 2016

(87) PCT Pub. No.: WO2016/007156

PCT Pub. Date: Jan. 14, 2016

(65) Prior Publication Data

US 2017/0107799 A1 Apr. 20, 2017

(51) Int. Cl.
*E21B 43/116* (2006.01)

(52) U.S. Cl.
CPC ..... *E21B 43/116* (2013.01)

(58) Field of Classification Search
CPC ..... E21B 43/116; E21B 43/117; E21B 43/118
USPC ..... 89/1.15, 1.151; 175/4.6, 4.56
See application file for complete search history.

(56) References Cited

U.S. PATENT DOCUMENTS 5,698,814 A * 12/1997 Parsons ..... B26F 3/04 102/307
6,865,978 B2 * 3/2005 Kash ..... E21B 43/117 102/313
7,246,548 B2 * 7/2007 Kash ..... E21B 34/117 102/313
7,721,649 B2 * 5/2010 Hetz ..... F42B 1/036 102/307

(Continued)

OTHER PUBLICATIONS

Lee, PCT Written Opinion for PCT Application No. PCT/US2014/046028 dated Apr. 9, 2015.

*Primary Examiner* — Joshua E Freeman
(74) *Attorney, Agent, or Firm* — Locke Lord LLP; Daniel Nguyen; Joshua L. Jones

(57) ABSTRACT

At least one crack designator for a perforating gun, wherein the gun includes a longitudinal direction, a lateral direction, and at least one scallop, wherein each crack designator is capable of redirecting crack growth from the lateral direction to the longitudinal direction of the gun. The designator may be located in one of the scallops, extend from an expected exit hole in the gun to an edge of one of the scallops, and be capable of redirecting crack growth from a lateral direction to a longitudinal direction of the gun. In preferred embodiments, the designator in each scallop is arranged in a spider pattern or concentric circles. The designator is preferably formed by machining, etching, or laser ablation. The designator may have a lower fracture toughness or lesser stiffness than surrounding material of the gun.

15 Claims, 2 Drawing Sheets

(56) References Cited

U.S. PATENT DOCUMENTS

| | | | | |
|---|---|---|---|---|
| 9,810,048 | B2 * | 11/2017 | Balun | E21B 43/116 |
| 2004/0107825 | A1 * | 6/2004 | Kash | E21B 43/117 89/1.15 |
| 2004/0216633 | A1 | 11/2004 | Kash | |
| 2005/0217842 | A1 | 10/2005 | Kash | |
| 2011/0000669 | A1 | 1/2011 | Barlow et al. | |
| 2012/0160492 | A1 * | 6/2012 | Andrzejak | C06B 33/08 166/297 |
| 2013/0000472 | A1 * | 1/2013 | Mhaskar | E21B 43/117 89/1.151 |
| 2013/0036898 | A1 | 2/2013 | Kash et al. | |
| 2013/0126238 | A1 * | 5/2013 | Church | F42B 1/032 175/2 |
| 2015/0053380 | A1 * | 2/2015 | Army, Jr. | B23H 1/00 165/166 |

* cited by examiner

PERFORATION CRACK DESIGNATOR

FIELD OF INVENTION

The embodiments disclosed herein relate to perforating guns used in well bore applications.

BACKGROUND OF INVENTION

Well completion techniques can require perforation of the casing. The casing is perforated in strata that may contain the hydrocarbons of interest. Charges from a perforation gun can perforate the casing wall and shatter the formation sufficiently to facilitate the flow of the hydrocarbons into the well.

A perforating gun can be used for these applications. Perforating gun failures can occur when a crack initiates at an exit hole and grows in a lateral direction with respect to the longitudinal direction of the gun.

DETAILED DESCRIPTION OF DISCLOSED EMBODIMENTS

As an initial matter, it will be appreciated that the development of an actual, real commercial application incorporating aspects of the disclosed embodiments will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time.

While a developer's efforts might be complex and time-consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
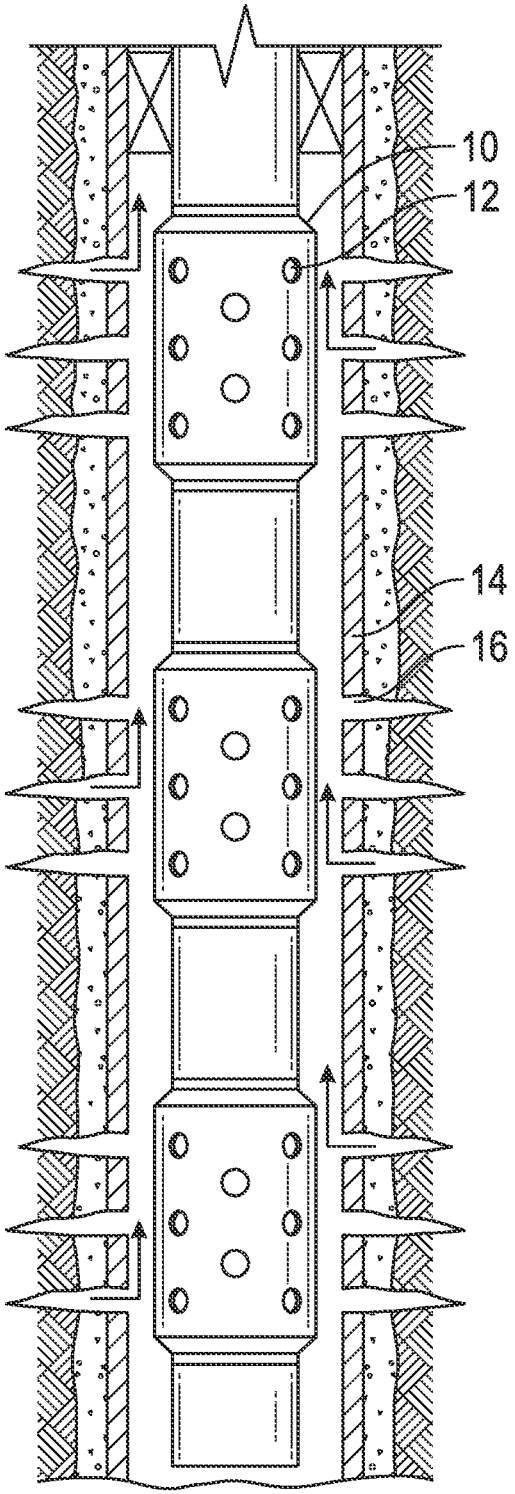
FIG. 1 is a partial, side cross-sectional view of an embodiment of a perforating gun.

Well completion techniques can require perforation of the casing. The casing is perforated in strata that may contain the hydrocarbons of interest. Charges perforate the casing wall and shatter the formation sufficiently to facilitate the flow of the hydrocarbons into the well. A perforating gun 10 can be used as shown in FIG. 1. As shown, the gun 10 contains charges 12. These charges may be arranged in different geometric configurations that are beneficial to perforating the casing 14. The charges 12 are connected to a detonator by a detonator cord.

The gun 10 can be lowered into a well bore. When the gun is in the proper position in the well bore, the charges 12 are ignited, and an explosive jet of high-energy perforates the gun 10 and casing 14 of the well bore while fracturing and penetrating the strata outside the casing. The gun can then be extracted. Hydrocarbons can then enter via the new perforations 16 into the casing.

Figure 2:
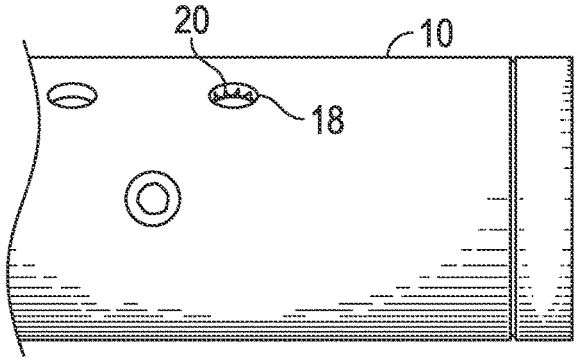
FIG. 2 is a partial, perspective view of a perforating gun surface after the discharge of a charge.

The gun 10 preferably contains scallops machined or cut along the outer surface of the gun 10 that allow for protruding extensions to protrude without protruding beyond the outer dimension or diameter of the gun 10. One goal of the scallop 18 is to accommodate the protruding extensions or burrs that are created so that these burrs do not hinder in the removal or extraction of the gun after use. FIG. 2 shows a scallop 18 in a gun 10 after use. The protruding extensions or burrs 20 are shown.

Figure 3:
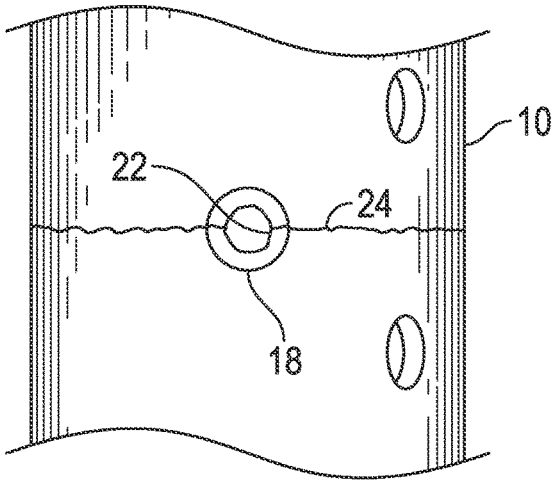
FIG. 3 is a partial, side view of a perforating gun wall showing a lateral crack.
Figure 4:
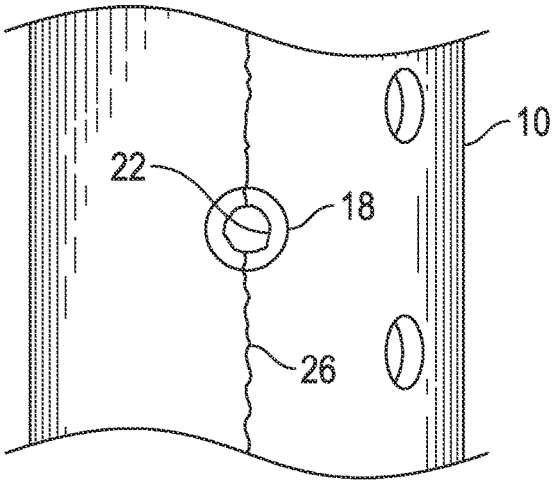
FIG. 4 is a partial, side view of a perforating gun wall showing a longitudinal crack.

Perforating gun failures can occur when a crack initiates at an exit hole and grows in a lateral direction with respect to the longitudinal direction of the gun 10 as shown in FIG. 3. The lateral crack 24 can extend from the exit hole 22 and the scallop 18 and result in catastrophic parting failures. In contrast, a crack 26 in the longitudinal direction of the gun 10 is shown in FIG. 4, while undesirable, tends to be less catastrophic in nature. The lateral cracks 24 grow in response to axial tensile stresses in the region around the exit hole 22. The longitudinal cracks 26 typically grow in response to hoopwise tension resulting from differential burst pressure.

The present invention encourages cracks that grow laterally to turn in a longitudinal direction before exceeding the scallop 18 boundary. A secondary goal of the designs is to address cracks that have exceeded the scallop boundary by continuing to turn them in a longitudinal direction with respect to the gun 10. The driving stresses that cause crack growth tend to be short pulses occurring over a period of only milliseconds. If some of the growth can be shifted toward the longitudinal direction, then the total lateral excursion of the crack may be reduced. The shorter the final crack length after this critical post-detonation period, the less likely it is for the gun to reach a critical fracture length that could result in a parting failure. Once the lateral extent of a crack or multiple cracks in one cross section has exceeded a critical percentage of the cross section, the gun will no longer be able to survive the axial dynamic loading post-detonation.

Figure 5:
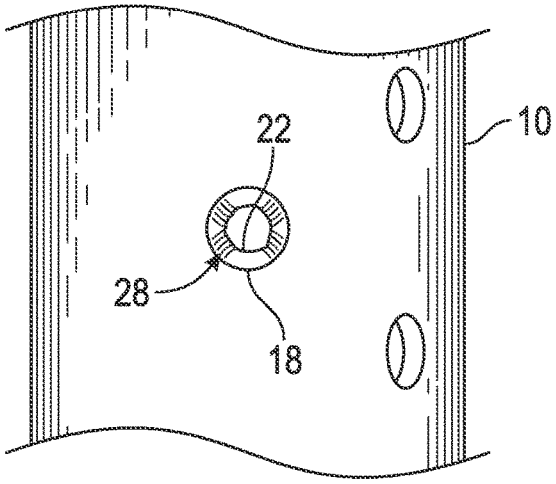
FIG. 5 is a partial, side view of a perforating gun wall with tracks in a spider pattern.
Figure 6:
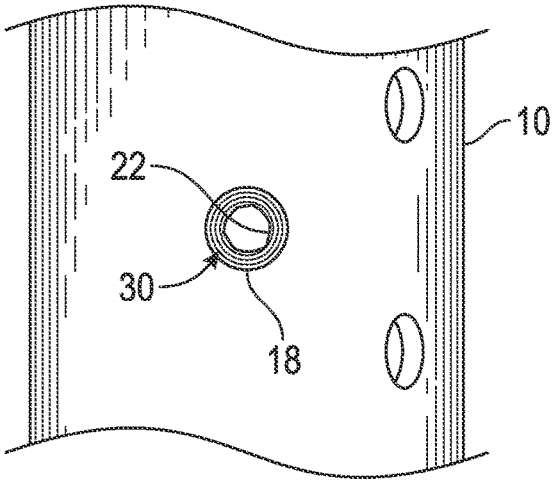
FIG. 6 is a partial, side view of a perforating gun wall with tracks in a concentric ring pattern.

One method for encouraging the crack growth path is to define crack tracks within the scallop region 18 and in the region outside of the scallop region of the gun wall. Research has determined that it is the exit holes 22 that serve as the initiation point for cracks. The cracks have a high stress concentration so that the dynamic loading during detonation results in high local stresses that can drive crack growth. The defined tracks would consist of narrow stress concentrating curves that start at the exit hole near the scallop center and gradually curve in a longitudinal direction. This preferred design may be referred to as a "spider" pattern 28 as shown in FIG. 5. An alternate design would incorporate concentric rings 30 around the exit hole 22 as shown in FIG. 6. The patterns can extend beyond the exit hole 30 as well.

A preferred method of creating preferential crack paths is using a material removal process such as machining, etching, or laser ablation. Another means of directing crack growth is to provide a similar path of embrittled material that has a lower fracture toughness than the surrounding material of the gun. A lasing process can generate a localized heat treatment in a similar curved path as for a stress concentration method. The heat treated material will have a higher hardness and lower toughness making crack growth more likely along the path. This effect might also be achieved with a welding/cutting torch.

A third method of creating preferential crack paths is to locally work-harden the material to make it harder and less ductile. This might be achieved through directed shot-peening or other mechanical loading of the gun wall.

A fourth approach is to use an additive process to locally stiffen the gun wall. While the added material might make the gun stronger if considered in a uniform treatment, the local treatment could create a discontinuity and a barrier for turning cracks. For example, weld beads could be run along a crack path to create a track between or along the edges of the beads (which would also provide a heat-affected zone as in the second approach). Material can also be added using a laser deposition process or a bonding process.

It is important to consider the impact on the burst pressure rating of the gun that longitudinal stress concentrations may have. Machined grooves or keyways used for the alignment of charge carriers may contribute to burst failures particularly when the grooves are aligned with the last scallop. The groove terminates in the thread relief region at the end of the gun and is also in close proximity to the threads. Simulations have illustrated how such features can result in crack growth between crack initiation points such as exit holes and threads. If a longitudinal crack propagates to the thread relief or coupling threads, this can result in a similar catastrophic gun-parting failure. Thus, any design must take care not to weaken the gun for other modes of failure. Simulations can be used to optimize the path of the desired crack growth tracks to minimize the risk of lateral gun failures.

The present invention is at least one crack designator and method of making the same for a perforating gun, wherein the gun includes a longitudinal direction and at least one scallop, wherein each crack designator is capable of redirecting crack growth in the gun from a lateral direction to a longitudinal direction of the gun. The designator may be located in one of the scallops, extend from an expected exit hole in the gun to an edge of one of the scallops, and be capable of redirecting crack growth from a lateral direction to a longitudinal direction of the gun. In preferred embodiments, the designator in each scallop can be arranged in a spider pattern or concentric circles. The designator is preferably formed by machining, etching, or laser ablation. The designator may have a lower fracture toughness or lesser stiffness than the surrounding material of the gun.

The present embodiments are well adapted to attain the ends and advantages mentioned as well as those that are inherent therein. The particular embodiments disclosed above are illustrative only as the present invention may be modified and practiced in different but equivalent manners apparent to those skilled in the art having the benefit of the teachings herein.

Furthermore, no limitations are intended to the details of construction or design herein shown, other than as described in the claims below. It is therefore evident that the particular illustrative embodiments disclosed above may be altered, combined, or modified and that all such variations are considered within the scope and spirit of the present invention.

The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

While the disclosed embodiments have been described with reference to one or more particular implementations, those skilled in the art will recognize that many changes may be made thereto without departing from the spirit and scope of the description. Accordingly, each of these embodiments and obvious variations thereof is contemplated as falling within the spirit and scope of the claimed invention, which is set forth in the following claims.

What is claimed is:

1. At least one crack designator for a perforating gun, wherein the gun comprises a longitudinal direction, a lateral direction, and at least one scallop, wherein the at least one crack designator has a lesser stiffness than surrounding material of the gun and wherein the at least one crack designator defines a crack track that encourages crack growth in the gun in the longitudinal direction, the crack track redirecting crack growth in the gun from the lateral direction to the longitudinal direction of the gun.

2. The designator of claim 1 wherein the at least one designator is located in one of the scallops.

3. The designator of claim 2 wherein the at least one designator extends from an expected exit hole in the gun to an edge of one of the scallops.

4. The designator of claim 1 wherein the at least one designator in each scallop is arranged in a spider pattern.

5. The designator of claim 1 wherein the at least one designator in each scallop is arranged in concentric circles.

6. The designator of claim 1 wherein the at least one designator is formed by machining, etching, or laser ablation of the gun.

7. The designator of claim 1 wherein the at least one crack designator has a lower fracture toughness than surrounding material of the gun.

8. A perforating gun having a longitudinal direction and a lateral direction, at least one charge;

at least one scallop;

a detonator connected to each charge; and at least one crack designator, wherein the at least one crack designator has a lesser stiffness than surrounding material of the gun and wherein the at least one crack designator defines a crack track that encourages crack growth in the gun in the longitudinal direction, the crack track redirecting crack growth from the lateral direction to the longitudinal direction of the gun.

9. The gun of claim 8 wherein the at least one designator is located in one of the scallops.

10. The gun of claim 9 wherein the at least one designator extends from an expected exit hole in the gun to an edge of one of the scallops.

11. The gun of claim 9 wherein the at least one designator in each scallop is arranged in a spider pattern.

12. The designator of claim 9 wherein the at least one designator in each scallop is arranged in concentric circles.

13. A method of designating cracks in a perforating gun, wherein the gun comprises a longitudinal direction, a lateral direction, and at least one scallop, which comprises the step of:

installing at least one crack designator in the gun wherein the at least one crack designator has a lesser stiffness than surrounding material of the gun and wherein the at least one crack designator defines a crack track that encourages crack growth in the gun in the longitudinal direction, the crack track redirecting crack growth in the gun from the lateral direction to the longitudinal direction of the gun.

14. The method of claim 13 wherein the at least one designator is located in one of the scallops.

15. The method of claim 13 wherein the at least one designator extends from an expected exit hole in the gun to an edge of one of the scallops.

* * * * *